US006767184B2

(12) United States Patent
Kim et al.

(10) Patent No.: US 6,767,184 B2
(45) Date of Patent: Jul. 27, 2004

(54) BLOWER

(75) Inventors: Sung Chun Kim, Yongsan-ku (KR); Young Min Park, Inchun-si (KR); Jong Han Park, Kwangmyung-si (KR); Jun Sei Lee, Youngdungpo-ku (KR); Sung Oh Choi, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/096,588

(22) Filed: Mar. 14, 2002

(65) Prior Publication Data

US 2003/0049122 A1 Mar. 13, 2003

(30) Foreign Application Priority Data

Aug. 28, 2001 (KR) ..... 2001-52124

(51) Int. Cl.[7] ..... F04D 29/42

(52) U.S. Cl. ..... 415/204; 415/206; 415/119

(58) Field of Search ..... 415/119, 204, 415/206

(56) References Cited

U.S. PATENT DOCUMENTS 3,093,299 A * 6/1963 Hammann et al. ..... 415/90
4,884,946 A * 12/1989 Belanger et al. ..... 415/206
6,200,093 B1 * 3/2001 Lee et al. ..... 415/204
6,254,336 B1 * 7/2001 Ahn ..... 415/119

* cited by examiner

*Primary Examiner*—Ninh H. Nguyen
(74) *Attorney, Agent, or Firm*—Birch, Stewart, Kolasch & Birch, LLP

(57) ABSTRACT

A blower having a turbo fan is installed in a scroll housing with a cutoff. The cutoff has an inclination angle of approximately 50 to 80°, so that it is possible to draw in an increased amount of air while reducing the flow resistance of air. Accordingly, blowing efficiency is improved while simultaneously reducing the generation of noise and vibration.

10 Claims, 5 Drawing Sheets

BLOWER

BACKGROUND OF THE INVENTION

1. Field of the Invention

The present invention relates to a blower which is mounted to home appliances such as an air conditioner, vacuum cleaner, etc, in order to suck and discharge air. More particularly, the present invention relates to a blower which is equipped with a turbo fan installed at the interior of a scroll housing thereof, while enlarging the angle of inclination of a cutoff of the scroll housing, thereby enhancing blowing performance and reducing noise of the blower.

2. Description of the Related Art

As well known to those skilled in the art, a blower generally includes an impeller 1, so called a "sirocco fan", and a scroll housing 2 adapted to guide air sucked by the impeller 1, thereby discharging the sucked air through an outlet 26, as shown in FIGS. 1 and 2.

The impeller 1 includes a plurality of blades 1*a* supported by a rib 1*b*. The impeller 1 has a shaft 11 connected to the drive unit of a motor M. When the impeller 1 is rotated in accordance with an operation of the motor M, air is sucked into the interior of the scroll housing 2 through a sucking inlet 24 formed at the front end of the scroll housing 2 while being guided by a bell mouth 25. The sucked air is then fed along a gradually-enlarged passage to the outlet 26, and then outwardly discharged through the outlet 26.

The scroll housing 2 includes a body portion 2*a* having a substantially cylindrical shape while receiving the impeller 1. The body portion 2*a* serves to guide air sucked through the sucking inlet 24 in a rotating direction of the impeller 1. The scroll housing 2 also includes a hopper portion 2*b* extending upwardly from the body portion 2*a*. The hopper portion 2*b* serves to discharge the air introduced into the body portion 2*a* through the outlet 26.

The scroll housing 2 is constructed by a front panel 21 defined with the sucking inlet 24, a rear panel 22 spaced apart from the front panel 21 by a desired distance, and side panels 23 for sealing all edges of the front and rear panels 21 and 22, except for the outlet 26.

The hopper portion 2*b* has a right wall 23*a* extending vertically from the body portion 2*a*, and a left wall 23*b* extending inclinedly from the body portion 2*a* in such a fashion that the hopper portion 2*b* has a cross-sectional area gradually enlarged toward the outlet 26. That is, a cutoff 3 having a concave structure is formed between the body portion 2*a* and the hopper portion 2*b*.

The cutoff 3 extends from its cutoff portion 31 on the front panel 21 to it cutoff portion 32 on the rear panel 22 while being inclined with respect to the shaft 11 of the impeller 1 by an angle of $\theta_1$. Typically, the inclination angle $\theta_1$ of the cutoff 3 is 50° or less. Air discharged from the body portion 2*a* is guided along a flow passage defined by the hopper portion 2*b* to have a gradually-enlarged cross-sectional area from the cutoff 3, so that it is discharged from the outlet 26 in a state in which its pressure is converted from dynamic pressure into static pressure at the outlet 26.

However, the above mentioned conventional blower has a limitation in increasing the amount of blown air because the impeller 1 called a "sirocco fan" is installed in the interior of the scroll housing 2. Furthermore, the inclination angle $\theta_1$ of the cutoff 3 formed at the scroll housing 2 is 50° or less with respect to the shaft 11 of the impeller 1. As a result, there is a problem in that flow resistance of air passing through the hopper portion 2*b* is increased, thereby degrading the blowing efficiency of the blower while increasing generation of noise.

SUMMARY OF THE INVENTION

Therefore, the present invention has been made in view of the above problems, and it is an object of the present invention to provide a blower which is capable of increasing the flow rate of blown air while minimizing the flow resistance of air being discharged, thereby achieving an improvement in blowing efficiency.

It is another object of the present invention to provide a blower which is capable of reducing generation of noise.

In accordance with the present invention, these objects are accomplished by providing a blower including a motor, a blowing fan coupled to the motor via a shaft, and a scroll housing including a front panel having a sucking inlet, a rear panel, and side panels sealing all edges of the front and rear panels, except for the outlet, the scroll housing defining a body portion serving to guide air sucked through the sucking inlet in a rotating direction of the blowing fan, a hopper portion extending from the body portion while serving to discharge the air introduced into the body portion through the outlet, and a cutoff formed at a boundary between the body and hopper portions to extend the front panel to the rear panel, wherein the cutoff of the scroll housing has an inclination of 50 to 80° with respect to the shaft of the blowing fan.

Preferably, the inclination of the cutoff is ranged from 60° to 70°.

Preferably, the blowing fan is a turbo fan in accordance with the present invention.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, an embodiment of the present invention will be described in conjunction with the annexed drawings.

Figure 1:
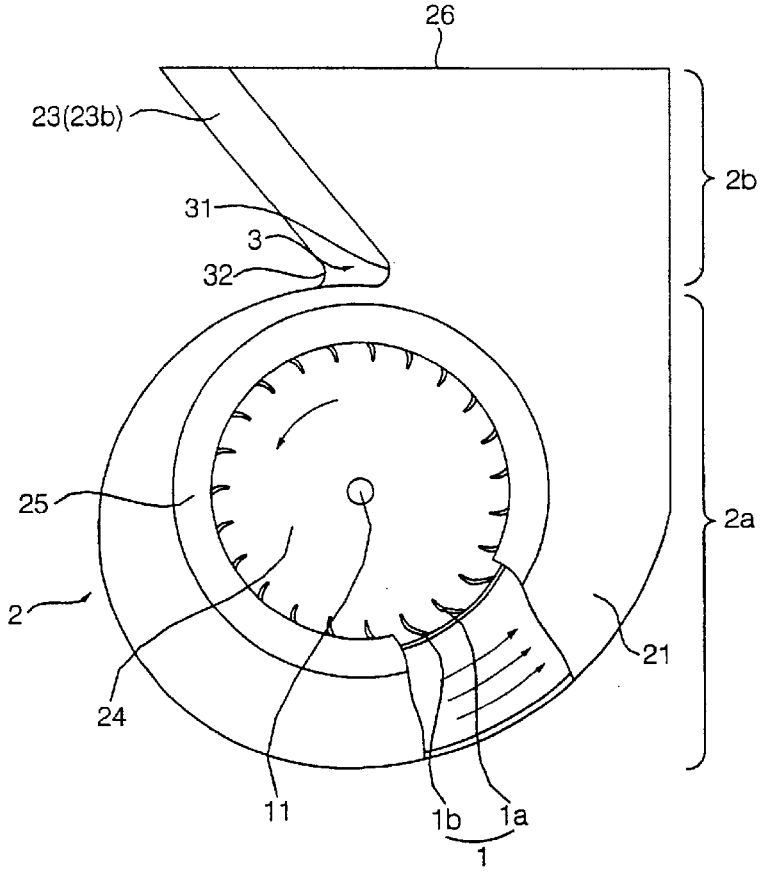
FIG.1(Prior Art)
FIG. 1 is a front view showing a conventional blower.
Figure 2:
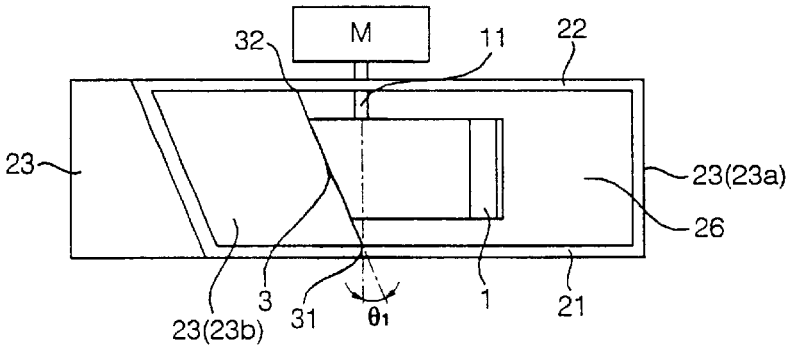
FIG.2(Prior Art)
FIG. 2 is a plane view of the conventional blower shown in FIG. 1.
Figure 3:
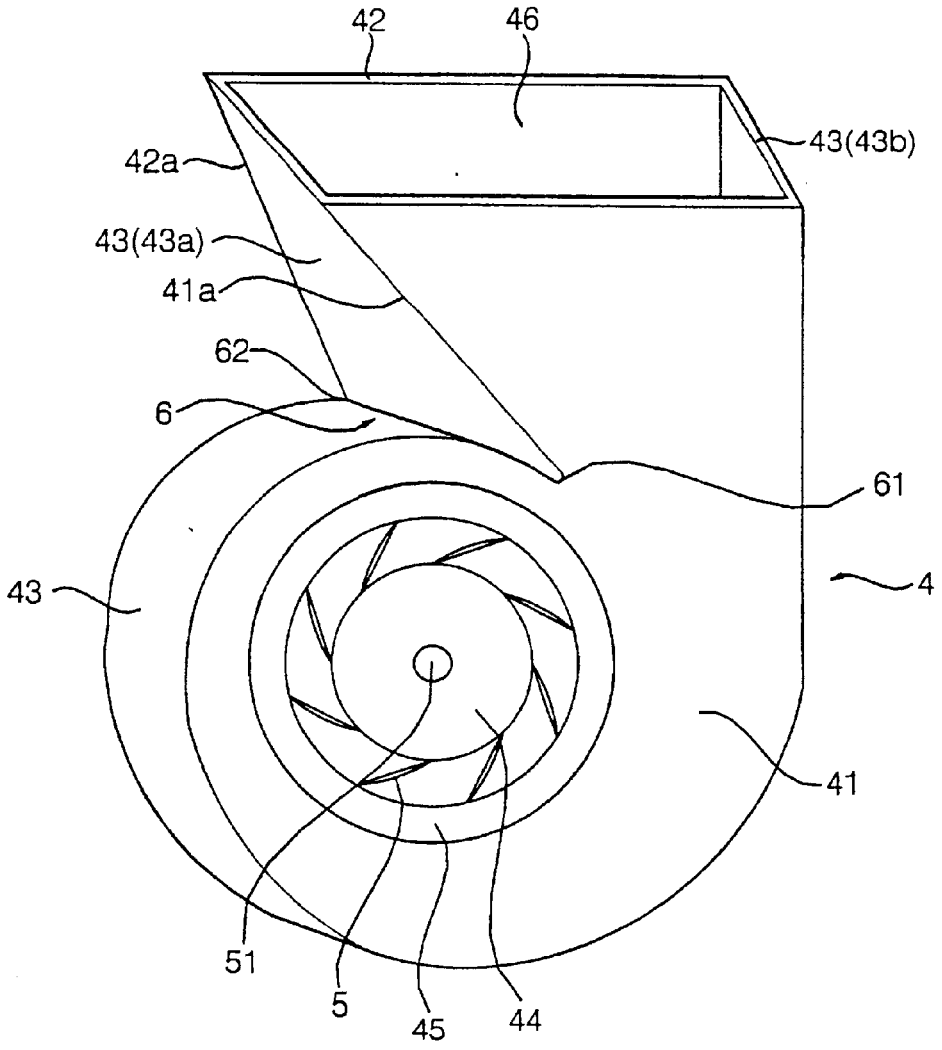
FIG. 3 is a perspective view showing a blower according to the present invention.
Figure 4:
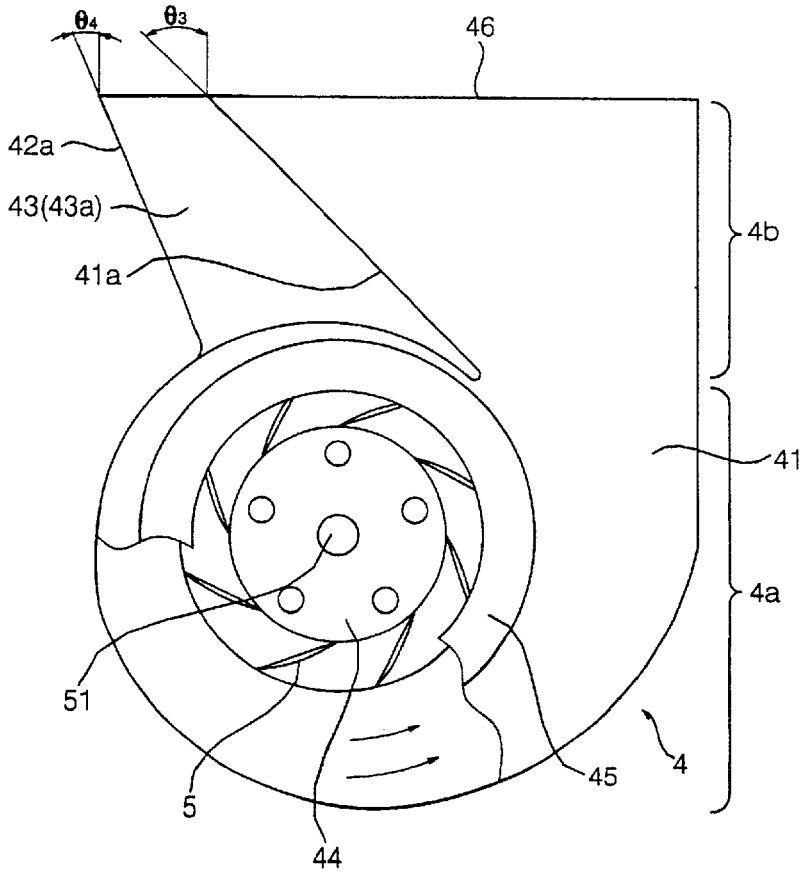
FIG. 4 is a partially sectioned front view showing the blower according to the present invention.
Figure 5:
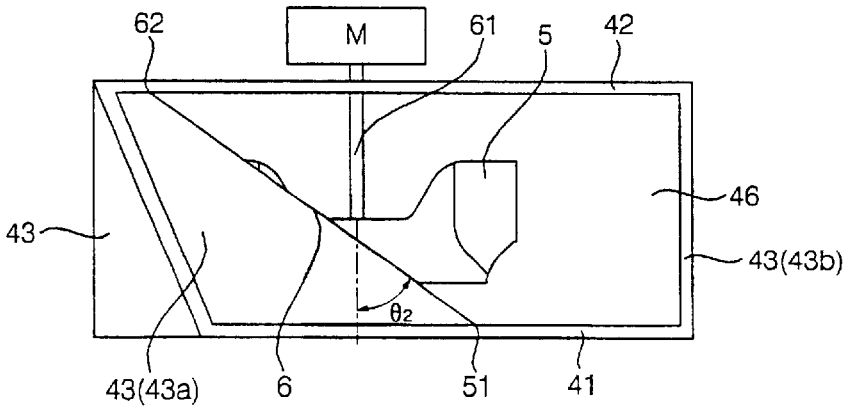
FIG. 5 is a plane view showing the blower according to the present invention.

FIG. 3 is a perspective view illustrating a blower according to the present invention. FIG. 4 is a partially-broken front view illustrating the blower according to the present invention. FIG. 5 is a plan view corresponding to FIG. 4.

As shown in FIGS. 3 to 5, the blower according to the present invention includes a scroll housing 4, and a turbo fan 5 installed in the interior of the scroll housing 4.

The scroll housing 4 includes a body portion 4*a* having a circular sucking inlet 44, and a bell mouse 45 arranged around the sucking inlet 44. A turbo fan 5 is installed in the body portion 4*a*. The body portion 4*a* serves to guide air sucked through the sucking inlet 44 in a rotating direction of the turbo fan 5. The scroll housing 4 also includes a hopper portion 4*b* having an outlet 46 while having a cross-sectional area gradually enlarged as it extends from the body portion 4*a* to the outlet 46. The hopper portion 4*b* serves to discharge air received from the body portion 4*a* through the outlet 46.

The scroll housing 4 is constructed by a front panel 41 defined with the sucking inlet 44, a rear panel 42 spaced apart from the front panel 4, and side panels 43 for sealing all edges of the front and rear panels 41 and 42, except for the outlet 46.

The hopper portion 4*b* has a right wall 43*b* extending vertically from the body portion 4*a* to the outlet 46. A cutoff 6, which is concave in a right direction, is formed at the boundary between the body portion 4*a* and the hopper portion 4*b*.

The cutoff 6 has a cutoff portion 61 formed at the front panel 41, and a cutoff portion 62 formed at the rear panel 42. The cutoff portion 61 is more concave than the cutoff portion 62. The cutoff 6 extends between the cutoff portions 61 and 62 along the side panel 43 corresponding to the left wall 43*a* of the hopper portion 4*b*. The cutoff 6 has an inclination angle $\theta_2$ of 50 to 80° with respect to the shaft 51 of the blowing fan 5.

The cutoff 6 has an inner surface curved toward the body portion 4*a* so as to prevent the air introduced from the body portion 4*a* into the hopper portion 4*b* from flowing turbulently.

The left edges 41*a* and 42*a* of the front and rear panels 41 and 42, at which the cutoff portions 61 and 62 are respectively formed, are inclined in order to allow the hopper portion 4*b* to have cross-sectional areas gradually enlarged from the associated cutoff portions 61 and 62 to the outlet 46, respectively.

In the embodiment of the present invention illustrated in FIGS. 3 to 5, the left edge 41*a* of the front panel 41 extending from the cutoff portion 61 to the outlet 46 has an inclination angle $\theta_3$ with respect to the vertical, whereas the left edge 42*a* of the rear panel 42 extending from the cutoff portion 62 to the outlet 46 has an inclination angle $\theta_4$ with respect to the vertical. The inclination angle $\theta_3$ is larger than the inclination angle $\theta_4$. Also, the width of the front panel 41 at the outlet 46 is smaller than the width of the rear panel 42 at the outlet 46. Accordingly, the outlet 46 has a trapezoidal shape having one inclined side.

The front and rear panels 41 and 42 may have the same width at the outlet 46. In this case, the outlet 46 has a rectangular shape.

Alternatively, the inclination angle $\theta_3$ of the left edge 41*a* of the front panel 41 may be equal to the inclination angle $\theta_4$ of the left edge 42*a* of the rear panel 42.

Because the blower according to the present invention is equipped with the turbo fan 5 as its blowing fan, air sucked into the scroll housing 4 is introduced into the interior of the turbo fan 5, and then outwardly discharged after passing through spaces among the blades of the turbo fan 5. Accordingly, a relatively increased amount of air can flow while changing in direction at a large angle, as compared to conventional cases using a sirocco fan. As a result of a number of experiments, it was found that when the inclination angle $\theta_2$ of the cutoff 6 is 50 to 80°, air passing through the hopper portion 4*b* experiences a minimum of flow resistance.

The following Table shows the results of a test for measuring noise generated at the blower under the condition in which the inclination angle $\theta_2$ of the cutoff 6 is varied.

TABLE

| Inclination Angle ($\theta_2$) | Noise dB (A) |
|---|---|
| 30° | 52 |
| 40° | 50 |
| 50° | 49 |
| 60° | 47 |
| 65° | 455 |
| 70° | 46.5 |
| 80° | 48 |

Figure 6:
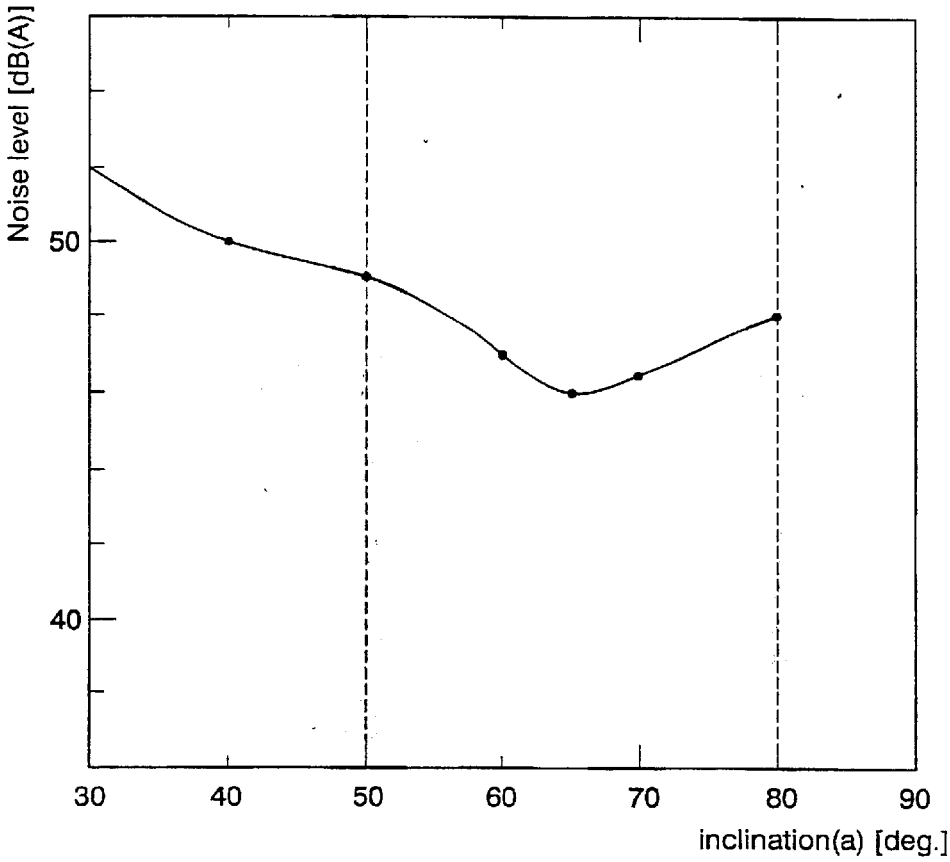
FIG. 6 is a graph depicting a variation in noise depending on a variation in the inclination angle of a cutoff in a blower.

Referring to the results of the Table and FIG. 6, it can be seen that where the inclination angle $\theta_2$ of the cutoff 6 is less than 50°, noise generated at the blower decreases gently as the inclination angle $\theta_2$ increases. On the other hand, where the inclination angle $\theta_2$ of the cutoff 6 is more than 50°, noise generated at the blower decreases greatly as the inclination angle $\theta_2$ increases, until it is minimized at about 65°.

Figure 7:
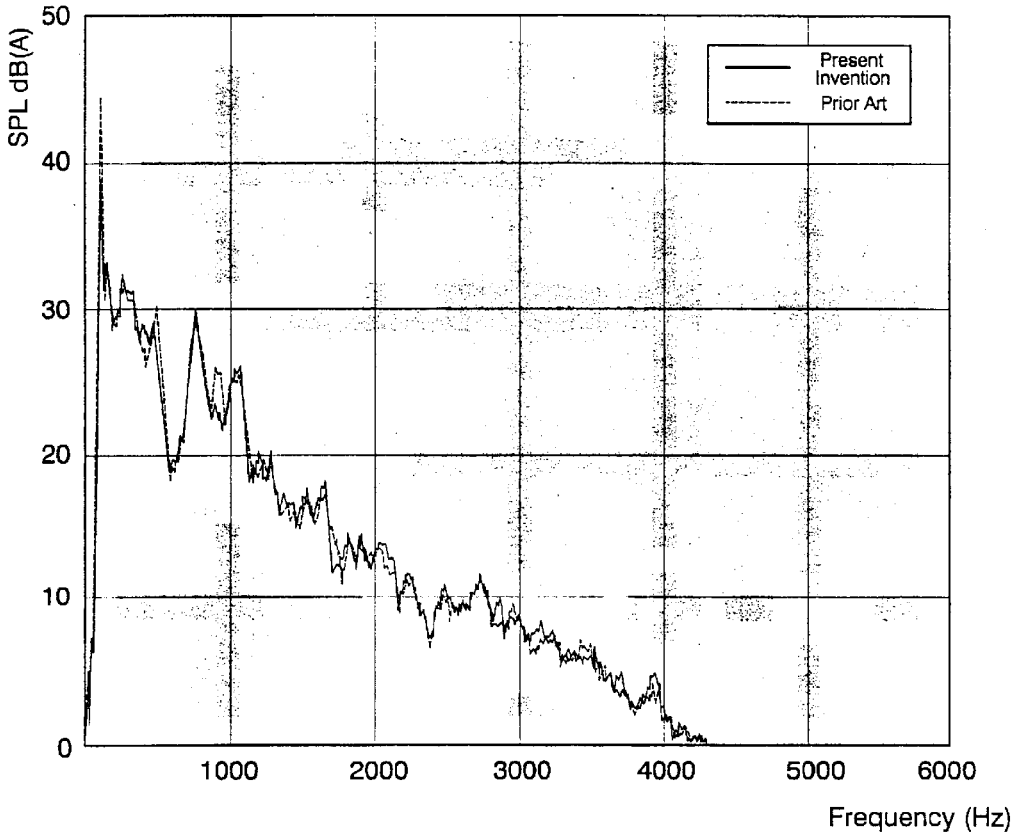
FIG. 7 is a graph depicting a variation in SPL (Sound Pressure Level) depending on a variation in BPF (Blade Passage Frequency) for a blower according to the present invention and a conventional blower.

FIG. 7 is a graph depicting the results of experiments measuring a variation in SPL (Sound Pressure Level) depending on a variation in the flowing frequency of air passing blades, that is, BPF (Blade Passage Frequency) for a blower according to the present invention using a turbo fan in which the inclination angle of its cutoff is 60° and the number of blades is 8, and a conventional blower using a sirocco fan in which the inclination angle of its cutoff is 45° and the number of blades is 40.

Here, "BPF" is expressed by "$2\pi$*RPM/n" in which "RPM" is the revolution per minute of the motor, and "n" is the number of blades.

As shown in FIG. 7, at a BPF of about 120 Hz, the intrinsic frequency of the conventional blower set corresponds to that BPF, so that the blower generates increased noise. In this case, SPL corresponds to 44 dB(A). However, the blower equipped with the turbo fan according to the present invention exhibits a reduced SPL, that is, 38 dB(A) because it uses a reduced number of blades while having a cutoff with an increased inclination angle. Namely, the maximum value of SPL according to the present invention is lower than that of the conventional blower by about 6 dB. Accordingly, the present invention achieves a reduction in noise.

As apparent from the above description, the present invention provides a blower in which a turbo fan is installed in a scroll housing having a cutoff with an inclination angle of about 50 to 80°, so that it is possible to suck an increased amount of air while reducing the flow resistance of air, thereby achieving an improvement in blowing efficiency while reducing generation of noise and vibrations.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A blower comprising:

a motor;

a blowing fan coupled to the motor via a shaft;

a scroll housing including a front panel having a sucking inlet, a rear panel, and side panels sealing all edges of the front and rear panels, except for the outlet, the scroll housing defining a body portion serving to guide air sucked through the sucking inlet in a rotating direction of the blowing fan;

a hopper portion extending from the body portion while serving to discharge the air introduced into the body portion through the outlet; and a cutoff formed at a boundary between the body and hopper portions to extend the front panel to the rear panel, wherein the cutoff of the scroll housing has an inclination of 50 to 80° with respect to the shaft of the blowing fan and a cutoff portion of the cutoff formed at the front panel is more concave than a cutoff portion formed at the rear panel.

2. The blower as set forth in claim 1, wherein the inclination of the cutoff ranges from 60° to 70°.

3. The blower as set forth in claim 1, wherein the blowing fan is a turbo fan.

4. The blower as set forth in claim 3, wherein the turbo fan has eight blades.

5. The blower as set forth in claim 1, wherein the scroll housing is inclined as the scroll housing extends from the cutoff to the outlet so that the hopper portion has a gradually increasing cross-sectional area.

6. The blower as set forth in claim 1, wherein the front and rear panels of the scroll housing are inclined at the same angle as the front and rear panels extend from the cutoff to the outlet.

7. The blower as set forth in claim 1, wherein the front and rear panels of the scroll housing are inclined at different angles as the front and rear panels extend from the cutoff to the outlet so that the inclination of the front panel is larger than the inclination of the rear panel.

8. The blower as set forth in claim 1, wherein the outlet has a trapezoidal shape having an inclined side arranged toward the cutoff.

9. The blower as set forth in claim 1, wherein the outlet has a rectangular shape.

10. A blower comprising:

a motor;

a turbo fan coupled to the motor via a shaft, wherein the turbo fan has eight blades;

a scroll housing including a front panel having a sucking inlet, a rear panel, and side panels sealing all edges of the front and rear panels, except for the outlet, the scroll housing defining a body portion serving to guide air sucked through the sucking inlet in a rotating direction of the blowing fan;

a hopper portion extending from the body portion while serving to discharge the air introduced into the body portion through the outlet; and a cutoff formed at a boundary between the body and hopper portions to extend the front panel to the rear panel, wherein the cutoff of the scroll housing has an inclination of 50 to 80° with respect to the shaft of the blowing fan.

* * * * *